United States Patent [19]

Tatsumi et al.

[11] Patent Number: 4,489,485

[45] Date of Patent: Dec. 25, 1984

[54] METHOD FOR FORMING A THERMAL PRINTING HEAD

[75] Inventors: Yutaka Tatsumi, Osaka; Hideo Taniguchi, Kyoto, both of Japan

[73] Assignee: Rohm Company Limited, Kyoto, Japan

[21] Appl. No.: 557,369

[22] Filed: Dec. 2, 1983

Related U.S. Application Data

[62] Division of Ser. No. 298,068, Aug. 31, 1981, Pat. No. 4,463,246.

[30] Foreign Application Priority Data

Sep. 8, 1980 [JP] Japan ..... 55-124997

[51] Int. Cl.[3] ..... H01C 17/06; H05B 1/00

[52] U.S. Cl. ..... 29/620; 29/612; 219/216; 219/543; 338/309; 338/328; 346/76 PH; 427/102

[58] Field of Search ..... 219/216, 216 PH, 543; 338/217, 308, 309, 323, 328, 330; 427/102, 103; 29/611, 612, 620, 621; 346/76 PH

[56] References Cited

U.S. PATENT DOCUMENTS

| | | | |
|---|---|---|---|
| 3,973,106 | 8/1976 | Ura | 219/216 |
| 4,037,315 | 7/1977 | Stapleton | 29/620 X |
| 4,203,025 | 5/1980 | Nakatami et al. | 219/216 |
| 4,241,193 | 12/1980 | Ohkubo et al. | 427/103 |
| 4,367,395 | 1/1983 | Asakawa et al. | 219/216 |

*Primary Examiner*—Volodymyr Y. Mayewsky
*Attorney, Agent, or Firm*—Christensen, O'Connor, Johnson & Kindness

[57] ABSTRACT

A method for forming a thermal printing head comprising a base of electrically insulating material, a glaze layer formed on said base so as to form an elongated projection thereon, said glaze layer comprising a main portion and a portion integral with and extending from said main portion, at least one thermal printing element formed on said main portion of said glaze layer, and an area formed in said extending portion of said glaze layer to relieve said glaze layer of surface tension when glaze is sintered and then cooled to form said glaze layer on said base.

7 Claims, 20 Drawing Figures

METHOD FOR FORMING A THERMAL PRINTING HEAD

This is a divisional of the prior application Ser. No. 298,068, filed Aug. 31, 1981, now U.S. Pat. No. 4,463,246, the benefit of the filling dates of which are hereby claimed under 35 USC 120.

This invention relates to a thermal printing head for use in thermal printing.

In one known thermal printing head, a base of electrically insulating material such as ceramic is covered with a glaze layer on the surface of which thermal printing elements of electrically resistive material are provided. Usually, the glaze layer is formed by applying glaze onto the surface of the base and sintering the applied material. The sintering, however, causes the periphery of the glaze layer to rise or protrude. The protuberance is believed to have been formed by the surface tension of the glaze material as it cools down and solidifies after it was heated to a softened condition.

When a printing head with such a protuberance as mentioned above on the glaze layer is applied onto a sheet of heat-sensitive paper for thermal printing, the protuberance abutting on the heat-sensitive paper causes a gap to exist between the sheet and the thermal printing elements of the printing head, thereby preventing effective transfer of heat from the elements to the paper with resulting incomplete coloring or blurring of the print.

Accordingly, it is one object of the invention to provide a thermal printing head which has no protuberance on the periphery of the glaze layer.

Another object of the invention is to provide a thermal printing head which ensures proper contact between the thermal printing elements and a sheet of heat-sensitive paper thereby enabling clear printing thereon.

Another object of the invention is to provide a thermal printing head wherein the thermal printing elements on the glaze layer are so arranged as to be brought into proper face-to-face relation to a sheet of heat-sensitive paper.

The invention will be described in detail with reference to the accompanying drawings, wherein.

Figure 15:
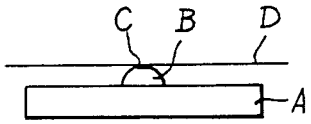
Figure 16:
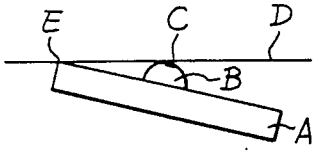
Figure 17:
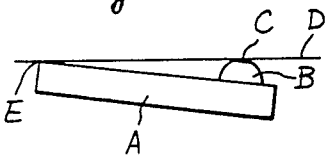
Figure 18:
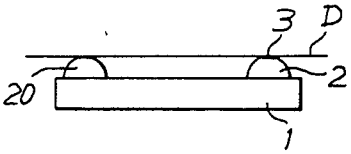
Figure 19:
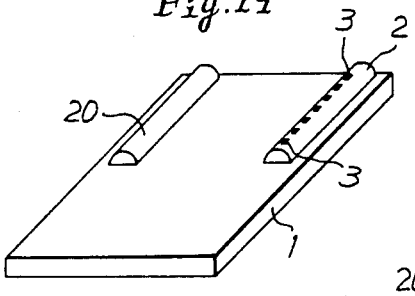
Figure 20:
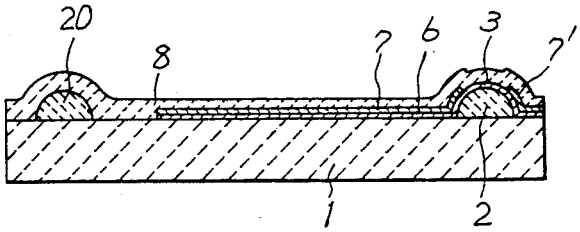

FIG. 15 schematically shows the printing head of the invention in use;

FIGS. 16 and 17 schematically show the printing head being used in an improper manner;

FIG. 18 is a schematic plan view of another embodiment of the invention;

FIG. 19 is a perspective view of the printing head shown in FIG. 18; and FIG. 20 is an enlarged transverse sectional view of the printing head shown in FIG. 19.

Figure 1:
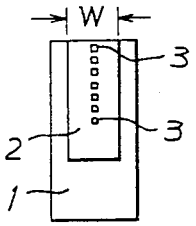
PRIOR ART Fig.1
FIG. 1 is a schematic front view of a known thermal printing head.
Figure 2:
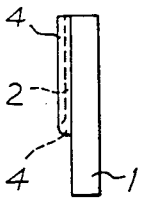
PRIOR ART Fig.2
FIG. 2 is a side view of FIG. 1.
Figure 3:
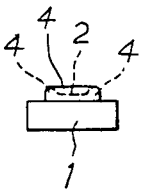
PRIOR ART Fig. 3
FIG. 3 is a bottom view of FIG. 1.

Referring first to FIGS. 1 to 3, there is shown a base 1 made of a suitable electrically insulating material such as ceramic. A glaze layer 2 is formed on the base 1 by printing followed by sintering, and a plurality of thermal printing elements 3 are provided on the surface of the glaze layer 2. In the illustrated embodiment, the elements are arranged in a single straight row. They may also be arranged in different patterns in accordance with the purposes for which the printing head is to be used.

The thermal printing elements 3 are made of a material having a suitable electrical resistance. In particular, a plurality of strips of a suitable electrically resistive material are formed on the surface of the glaze layer by printing or vacuum evaporation, so that the strips are spaced apart a suitable distance from each other longitudinally along the glaze layer and a pair of electrically conductive layers are applied onto each of the strips in such a manner that they are spaced apart from each other across that portion of the strip which is left exposed so as to become a thermal printing element.

When the pair of conductive layers are connected to a source of electricity, that portion of the electrically resistive strip which is between the two conductive layers is heated so as to function as a printing element.

To form the glaze layer, glaze is applied to the base by screen printing and then sintered. As previously mentioned, the sintering step causes the periphery of the applied glaze layer to swell or form a protrusion 4. In the illustrated embodiment, there is shown no protuberance at the upper end of the glaze layer. This is because a single glaze layer is formed so as to extend across a central border line on an original base plate having an area twice that of the base of a single printing head, and the original base plate is cut at the border line into two bases, so that no protuberance is formed at the cut end of each of the two separated bases. In practice, a larger base plate is provided, on which many glaze layers are sintered, with one layer covering an area twice the area of a single printing head.

Figure 4:
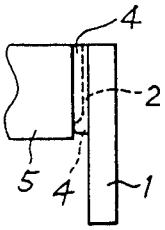
PRIOR ART Fig.4
FIG. 4 is a side view of FIG. 1 showing the printing head in use.

As shown in FIG. 4, when the printing head is applied to a platen 5, the protuberance 4 on the glaze layer 2 thereof abuts on the platen 5 thereby preventing proper contact of the thermal printing elements 3 on the surface of the glaze layer with a sheet of heat sensitive paper (not shown) on the surface of the platen 5, with resulting impossibility of the intended printing or incomplete coloring of the print.

In an effort to prevent formations of protuberance 4 on the glaze layer, 2 the present inventors have conducted various experiments and found out that as the width W of the glaze layer 2 is reduced to less than 0.8 mm and at the same time the thickness thereof, to less than 40 $\mu$m, the protuberance 4 at the opposite lateral edges of the glaze layer are combined so that the glaze layer becomes an elongated projection or swell having a plano-convex transverse sectional shape. At the lower end of the glaze layer 2, however, a protuberance 4 is still formed.

If the length of the glaze layer 2 is reduced to the order of 0.8 mm, the protuberance 4 at the longitudinal end of the glaze layer is eliminated. Such a short length, however, would not suffice for a plurality of thermal printing elements 3 to be formed on the glaze layer.

Figure 8:
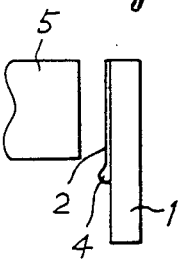
PRIOR ART Fig.8
FIG. 8 is a side view of FIG. 5 showing the printing head in use.

When the above-mentioned printing head having a protuberance 4 only at the lower end of the glaze layer 2 is applied onto a platen 5, the protuberance abuts on the platen. Since the glaze layer has no protuberance at the lateral edges, in order to avoid abutment of the protuberance at the lower end on the platen, the glaze layer may be made longer than the length of the face of the platen as shown in FIG. 8. However, unless the length of the glaze layer is made sufficiently long, even a little relative displacement between the printing head and the platen in the course of printing would cause the protuberance to abut on the platen. To avoid this the relative displacement must be strictly limited.

Figure 5:
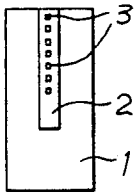
PRIOR ART Fig.5
FIG. 5 is a view similar to FIG. 1 but showing a modified form of the printing head.
Figure 6:
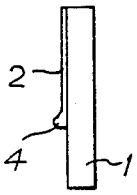
PRIOR ART Fig. 6
FIG. 6 is a side view of FIG. 5.
Figure 7:
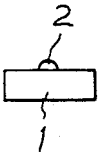
PRIOR ART Fig.7
FIG. 7 is a bottom view of FIG. 5.

In accordance with the invention, in order to prevent formation of a protuberance 4 as shown in FIGS. 5 and 6 at the lower end of the glaze layer 2, an area or portion to relieve the glaze layer of the surface tension of the material is provided adjacent to the longitudinal end of the glaze layer wherein a protuberance would otherwise be formed. The relieving area or portion may be formed by making the amount of glaze per unit area of contact with the base in that area or portion less than in the other areas or portions of the glaze layer.

Figure 9:
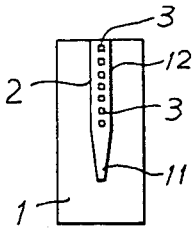
FIG. 9 is a schematic front view of one embodiment of the invention.
Figure 10:
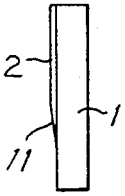
FIG. 10 is a side view of FIG. 9.
Figure 11:
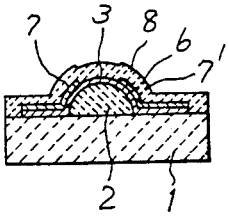
FIG. 11 is an enlarged transverse sectional view of the printing head shown in FIG. 9.

As can be understood from FIGS. 9 to 11 showing an embodiment of the invention, glaze is applied onto the surface of a base 1 by printing and then sintering to form a glaze layer 2, on which a plurality of thermal printing elements 3 are formed.

In particular, as shown in detail in FIG. 11, each of the elements 3 is formed by applying a heating layer 6 of a material having a suitable electrical resistance across the glaze layer 2 having a plano-convex cross-sectional shape, and then applying a pair of electrically conductive layers 7 and 7' onto the heating layer 6 at the opposite sides thereof across the glaze layer, leaving exposed the top area of the heating layer 6 which constitutes the printing element 3.

The whole surface of the printing head is preferably covered with a protective film 8 of a suitable wear-resistant material.

In the above arrangement, since the width and thickness of the glaze layer 2 are made less than 0.8 mm and 40 μm, respectively, there is no protuberance at the side edges of the glaze layer, which appears as a single elongated projection or swell having a plano-convex cross-sectional shape when viewed longitudinally.

In order to provide the glaze layer 2 with an area for relieving the surface tension of the glaze, in the embodiment of FIG. 9, the main portion or area 12 of the glaze layer 2 where the heating elements are provided is formed with a downwardly directed extension 11 tapering toward the lower end thereof, so that the extension becomes the relieving area. In particular, glaze is applied onto a base 1 by screen printing with a screen having a pattern wherein the lower end of the glaze layer 2 is tapered to a width narrower than the width of the main portion 12 as shown in FIG. 9. When the screen is removed after the printing, the glaze of the extension 11 slightly expands laterally so that the thickness of the extension 11 is gradually reduced toward the lower end thereof as shown in FIG. 10. In this arrangement, the amount of glaze per unit area is smaller in the extension 11 than in the main portion 12.

When the glaze layer formed in the above manner is then heated and subsequently cooled, only a small surface tension acts due to the small amount of glaze in the extension 11 so that little or no protuberance is formed in the extension 11. Should a protuberance happen to be formed, it would be lower than the height or thickness of the main portion 12.

Figure 12:
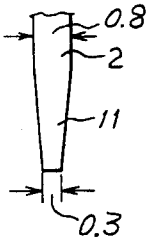
FIG. 12 is an enlarged fragmentary front view of the glaze layer shown in FIG. 9.

FIG. 12 shows exemplary dimensions of the pattern embodiment of the invention using the of the glaze layer 2 shown in FIG. 9. As previously mentioned, by reducing the width of the glaze layer 2 to less than 0.8 mm it is possible to have the layer shaped with a plano-convex cross-section. By reducing the width of the lower end of the tapering extension 11 to less than 0.3 mm it is possible to completely prevent formation of any protuberance thereon.

Figure 13:
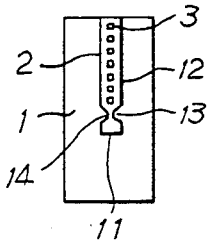
FIG. 13 is a schematic front view of another embodiment of the invention.
Figure 14:
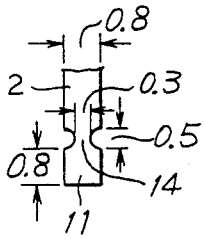
FIG. 14 is an enlarged fragmentary front view of the glaze layer shown in FIG. 13.

FIG. 13 shows another embodiment of the invention, wherein a constriction 14 is the glaze formed in layer 2 between the main portion 12 and a secondary portion 15 by forming a recess 13 in either or both sides of the layer 2. In this case, too, when the layer 2 is formed by printing, the portion secondary portion 15 expands laterally due to the ductility of the glaze so that due to the presence of the recesses 13 the portion secondary portion 15 becomes thinner than the main portion 12. Subsequently, when the glaze layer 2 is sintered and then cooled, only a small surface tension acts so that no protuberance is formed in the portion secondary portion 15 as in FIG. 9. Should any protuberance be formed, it would be lower than the thickness of the main portion 12.

By making the width of the glaze layer 2 less than 0.8 mm and the diameter of each of the recesses 13 greater than 0.5 mm and consequently the width of the constriction 14 less than 0.3 mm, it is possible to completely prevent formation of any protuberance in the secondary portion 15.

In this embodiment, the secondary portion 15 may be omitted. If the secondary portion remains, however, its length must be less than 0.8 mm. A larger length would cause a protuberance to be formed at the lower end of the secondary portion 15 portion.

If such a production method as would cause a protuberance to be formed at the upper end of the glaze layer is employed, a surface-tension relieving area similar to that shown in FIG. 9 or 13 may also be provided adjacent the upper end of the glaze layer.

With the above arrangement, it is possible to suppress formation of protuberances along the periphery of the glaze layer and insure proper contact of the thermal printing elements with a sheet of heat-sensitive paper on the platen without unnecessary elongation of the glaze layer.

With the above arrangement that the thermal printing elements are provided on the top surface of the glaze layer shaped like a having a plano-convex cross-sectional shape, it is possible to effect proper contact between the thermal printing elements 3 and a sheet of heat-sensitive paper on the platen 5, thereby to increasing the coloring density and clarity of the print.

If the glaze layer 2 is provided on the middle portion of the base 1, the following difficulty will arise. If the base 1 is held in parallel with a sheet D of heat-sensitive paper as shown in FIG. 15, the thermal printing element 3 on top the glaze layer 2 contacts the paper D properly. However, if the base 1 is tilted to either side for one cause or another as shown in FIG. 16, the thermal printing element 3 departs from the paper D so that the coloring density of the print is reduced or the print becomes obscure. Moreover, relative sliding movement of the base 1 and the heat-sensitive paper D causes the edge E of the base to rub or scrape the surface of the paper D thereby to reduce the relative slidability of the two members and make the surface of the paper dirty.

If the glaze layer 2 is provided adjacent one side edge of the base 1 as shown in FIG. 17, any unbalance in the force to press the printing head onto the heat-sensitive paper D causes the base 1 to be tilted so that the edge of the base rubs or scrapes the paper and the printing element does not properly contact the paper.

In accordance with the invention, therefore, a dummy glaze layer 20 is formed in parallel with the glaze layer 2 on the surface of the base 1. The dummy glaze layer 20 may be formed simultaneously with the glaze layer 2 with the same material, or the two layers may be formed at different times. Preferably the two layers are of the same shape except that there are no thermal printing elements on the dummy glaze layer.

With the arrangement of FIGS. 18 to 20, the two glaze layers 2 and 20 cooperate to keep the base in parallel with the heatsensitive paper D even when the pressing force is more or less unbalanced.

What we claim is:

1. A method for forming a thermal printing head, comprising:

laying a base of an electrically insulating material;

forming a glaze layer having a raised surface on said base, said raised surface of said glaze layer having an elongated main portion and an extension from an end of said main portion, said extension having less glaze per unit area than said main portion to relieve the glaze layer of surface tension; and, forming a thermal printing element on said main portion of said glaze layer.

2. The method of claim 1, wherein said extension is tapered to a width narrower than the width of said main portion.

3. The method of claim 2, wherein said extension is tapered to a transverse section height less than the transverse section height of said main portion.

4. The method of claim 3, wherein said main portion of said glaze layer is plano-convex in transverse section and has a curved top surface on which said thermal printing element is formed.

5. The method of claim 1, wherein said extension includes a constricted portion intermediate said main portion and said end of said extension.

6. The method of claim 5, wherein said extension is thinner than said main portion.

7. The method of claim 6, wherein said main portion of said glaze layer is plano-convex in transverse section and has a curved top surface on which said thermal printing element is formed.

* * * * *